United States Patent [19]

Porter

[11] 4,089,421

[45] May 16, 1978

[54] METHOD AND STRUCTURE FOR AUTOMATICALLY SEPARATING UNWANTED MATERIALS FROM MACHINE HARVESTED TOMATOES

[76] Inventor: Wellington W. Porter, Dublin Road, R.D. 2, Waterloo, N.Y. 13165

[21] Appl. No.: 731,901

[22] Filed: Oct. 13, 1976

Related U.S. Application Data

[63] Continuation-in-part of Ser. No. 604,820, Aug. 14, 1975, abandoned.

[51] Int. Cl.[2] ..... B07B 13/04; B07C 1/10; B07C 5/04

[52] U.S. Cl. ..... 209/97; 198/539

[58] Field of Search ..... 198/539, 560, 561, 546, 198/550, 551, 524, 528, 506, 594; 209/97, 241, 100, 367

[56] References Cited

U.S. PATENT DOCUMENTS

| | | | |
|---|---|---|---|
| 1,720,609 | 7/1929 | Rondolin | 198/560 X |
| 1,721,002 | 7/1929 | Cooper | 198/539 X |
| 3,213,782 | 10/1965 | Russell | 198/560 X |
| 3,388,812 | 6/1968 | Cooper | 198/560 X |
| 3,429,440 | 2/1969 | Hill | 209/241 |

*Primary Examiner*—John J. Love
*Assistant Examiner*—Douglas D. Watts
*Attorney, Agent, or Firm*—Charles S. McGuire

[57] ABSTRACT

Method and means for removing foreign matter and damaged fruit from a continuous supply of machine harvested tomatoes as they are moved through the crop discharge section of the harvester. The element is spaced from the exit end of the first conveyor by a distance which allows foreign matter such as dirt, stones, stems and small or damaged fruit to pass under the element and fall to the ground. The tomatoes to be gathered are too large to pass through the gap between the first conveyor and the hinged element, thus passing over the element and being deposited on the final discharge conveyor.

1 Claim, 11 Drawing Figures

METHOD AND STRUCTURE FOR AUTOMATICALLY SEPARATING UNWANTED MATERIALS FROM MACHINE HARVESTED TOMATOES

REFERENCE TO RELATED APPLICATION

This is a continuation-in-part of U.S. application Ser. No. 604,820, fild Aug. 14, 1975 and entitled Tomato Harvester Attachment, now abandoned.

BACKGROUND OF THE INVENTION

The present invention relates to methods and apparatus for automatically removing a substantial portion of foreign matter and damaged fruit from a harvested crop of tomatoes while passing through a high-capacity harvesting machine.

In applicant's prior U.S. Pat. No. 3,810,512 is disclosed a machine for harvesting tomatoes by removing the plants and fruit from the ground, shaking the vines to remove the fruit, and transporting the crop to a final discharge conveyor. Although the majority of dirt, stones, and other foreign matter normally fall through the chain-type conveyors during the harvesting operation, a certain amount remains with the fruit and may be discharged from the machine into the receiving structure for the harvested fruit. The unwanted materials may include small or damaged fruit as well as foreign matter such as plant stems, sticks or weeds. Such materials may, of course, be removed manually, but the high quantity of crop output per unit of time of which the machine is capable is not commensurate with thorough hand sorting.

It is a principal object of the present invention to provide a tomato harvesting machine which operates automatically to produce a final discharge of harvested fruit essentially free of foreign matter and other unwanted materials.

A further object is to provide a tomato harvester having means for automatically separating and discarding unwanted materials which is adjustable to vary the size of material which will be discarded.

Another object is to provide a method mechanically removing unwanted materials from a supply of harvested tomatoes as the latter moves through automated harvesting machinery.

Other objects will in part be obvious and will in part appear hereinafter.

SUMMARY OF THE INVENTION

In accordance with the foregoing objects, the invention includes an element which is installed on tomato harvesting apparatus between the final discharge conveyor chain and a lateral conveyor belt feeding material thereto. The harvesting apparatus may be otherwise conventional, such as that shown and described in aforementioned U.S. Pat. No. 3,810,512. In a first disclosed construction the element includes a substantially flat portion pivotally mounted on an axis parallel with those about which the two conveyors are moved, and at a position wherein the upper surface of the flat portion is in substantially the same plane as the upper surface of the conveyor belt and spaced therefrom by a predetermined gap. The element extends across the entire width of the lateral belt and slightly less than the width of the conveyor chain upon which the non-pivotal edge rests. The gap between the end of the lateral belt and adjacent edge of the element is adjustable and is set to allow the unwanted material to pass through the gap and fall to the ground. The harvested tomatoes, being too large to fall through the gap, pass over the pivoted element and onto the discharge conveyor chain.

In a second disclosed embodiment, operation is substantially the same, but construction is simpler and cheaper with no sacrifice of efficiency. The flat portion or member is eliminated altogether and only the freely pivotal rod remains between the two conveyors. Again, the rod extends across the full width of the lateral conveyor, which is a solid belt preferably of high surface friction, approximately in the plane of the upper surface thereof and spaced by a predetermined gap through which the unwanted materials may fall before reaching the final discharge conveyor chain.

DETAILED DESCRIPTION

Figure 1:
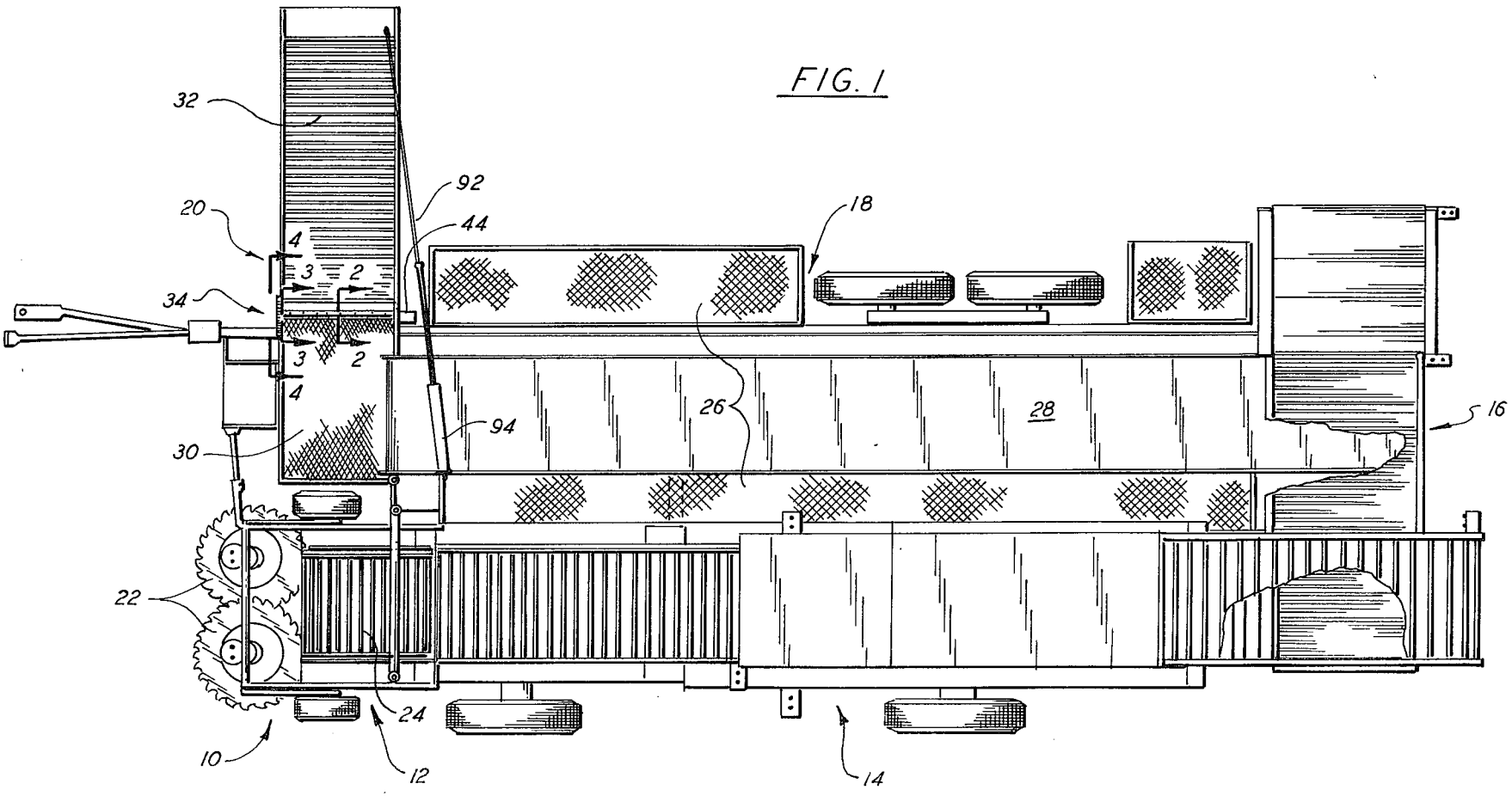
FIG. 1 is a plan view of a tomato harvester incorporating the present invention.

The harvester shown in FIG. 1 is adapted to be pulled by a tractor and various belts, shafts and other operating parts of the harvester are driven by hydraulic motors which receive pressurized fluid from pumps powered by the tractor power-take-off unit in conventional fashion. The harvester is generally comprised of header section 10, feeder section 12, shaker section 14, rear lateral conveyor section 16, sorting section 18 and discharge section 20. Details of construction and operation of all elements of the harvester, excepting those of the present invention, may be found in aforementioned U.S. Pat. No. 3,810,512. A pair of overlapping discs 22 are mounted on header section 10 with their forward edges working slightly below ground level and counter-rotated to lift and move rearwardly a bed of soil, plants and fruit. The plant stems are severed by the action of the discs, preferably as disclosed in copending application Ser. No. 604,819, now U.S. Pat. No. 3,999,613, of the present inventor.

The soil, plants with fruit attached, and loose fruit are discharged from the rear edges of discs 22 onto the lower, forward end of inclined conveyor 24 of feeder section 12. Conveyor 24 is of the open link or so-called potato chain type, whereby the majority of the soil falls through to the ground. Fruit is separated from the plants in shaker section 14, into which feeder section 12 discharges, from which the empty plants are discarded back into the field and the loose fruit transferred to rear lateral conveyor section 16. Platforms 26 are provided on each side of belt 28 of sorting section 18 to support several workers who manually remove damaged, unripe, or otherwise unwanted fruit and foreign matter from the materials moving on belt 28. The fruit is dropped from belt 28 to discharge section 20 which includes short, lateral conveyor belt 30 and final discharge conveyor chain 32.

Figure 2:
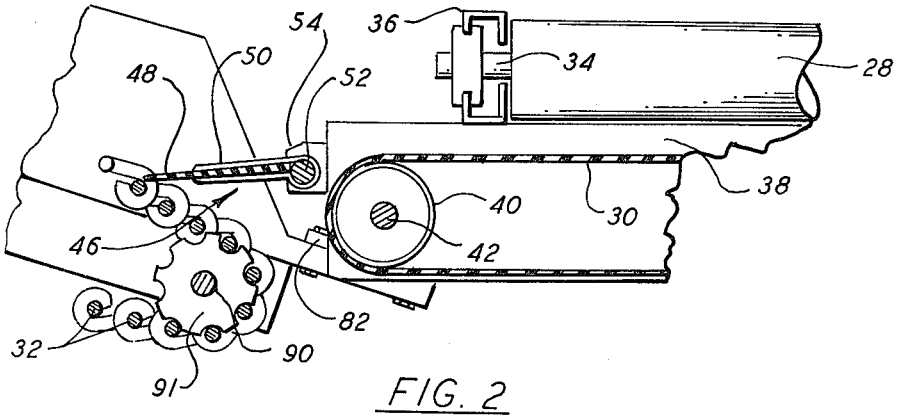
FIGS. 2–4 are a series of fragmentary side elevational views in section on the respectively numbered lines of FIG. 1.

The attachment of the present invention is positioned at the juncture of belt 30 and chain 32, being denoted generally in FIG. 1 by reference numeral 34. Details of construction of a first embodiment are shown in FIGS. 2–6 to which reference is now made. Belt 30 has an outer surface providing relatively high traction such as diamond tread rubberized material. Chain 32 is of the open link type, but the links are spaced closely enough to prevent fruit of the minimum desired size from falling through. Sorting belt 28, the discharge end of which may be seen in FIG. 2, is mounted on rollers, at least one of which is powered by one of the aforementioned hydraulic motors. The end of one of the roller axles 34 is seen in FIG. 2, mounted in suitable bearings on a portion of the frame 36. Metal guard or baffle 38 extends across the lower side of the discharge end of sorting belt 28 to prevent fruit from falling off the adjacent edge of conveyor belt 30.

Belt 30 is mounted for rotation about a pair of spaced, parallel rollers of like diameter, one of which is seen in FIG. 2, indicated by reference numeral 40. Shaft 42, upon which roller 40 is mounted is connected to hydraulic motor 44 (FIG. 1) to impart rotation to roller 40 and belt 30, as well as to chain 32 in a manner explained later herein. Element 46 is formed of a flat strip 48 of somewhat resilient material such as hard rubber which is retained between opposing layers of metal sheet 50. The latter loosely encircles rod 52, providing a pivotal mounting for element 46 along the edge adjacent the discharge end of belt 30. The ends of rod 52 are mounted on brackets 54 extending from stationary, upper frame portions 56 at each side of belt 30. Baffle 58 (FIG. 5) extends upwardly from frame portion 56 to prevent fruit from falling off the side of belt 30 opposite the side adjacent the discharge end of sorting belt 28.

Figure 3:
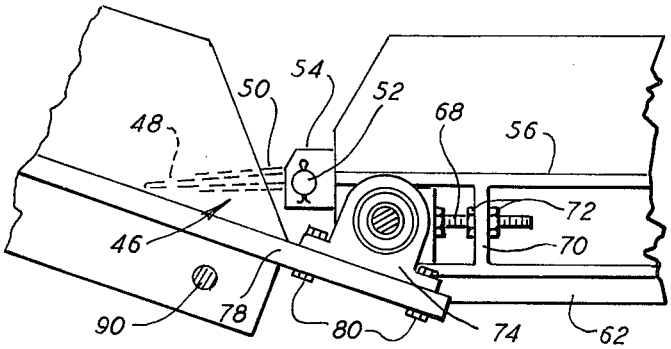
Figure 4:
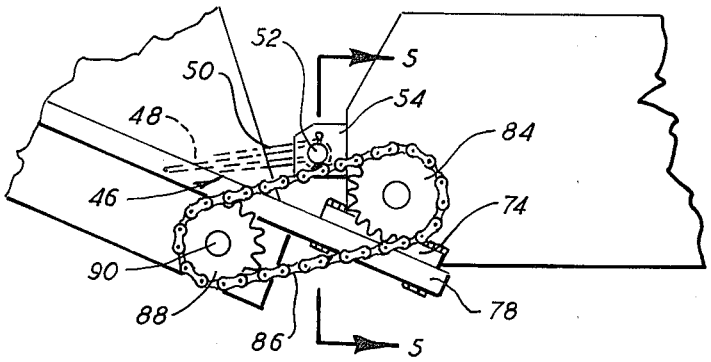
Figure 5:
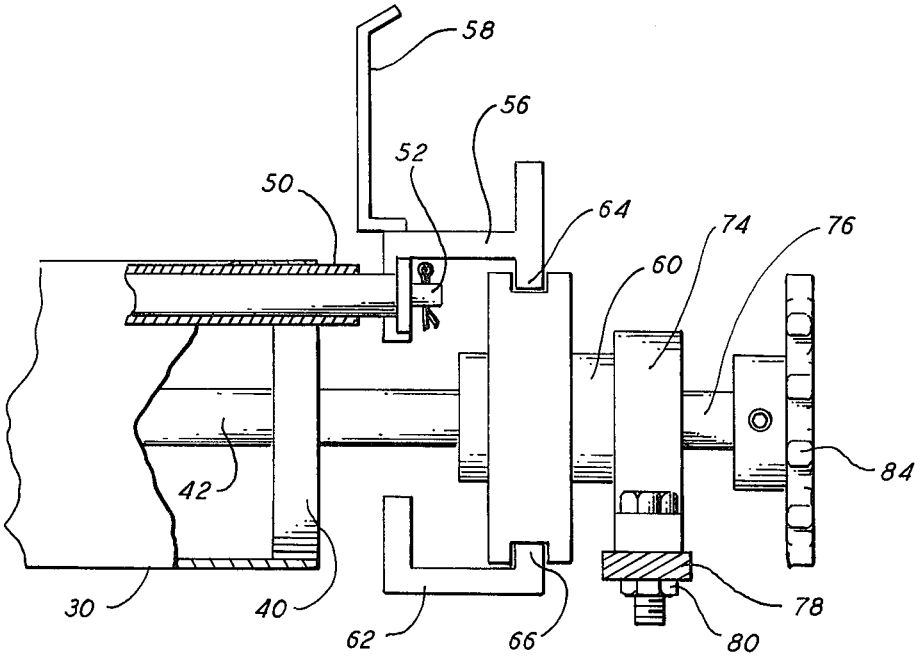
FIG. 5 is an end elevational view in section on the line 5—5 of FIG. 4.
Figure 6:
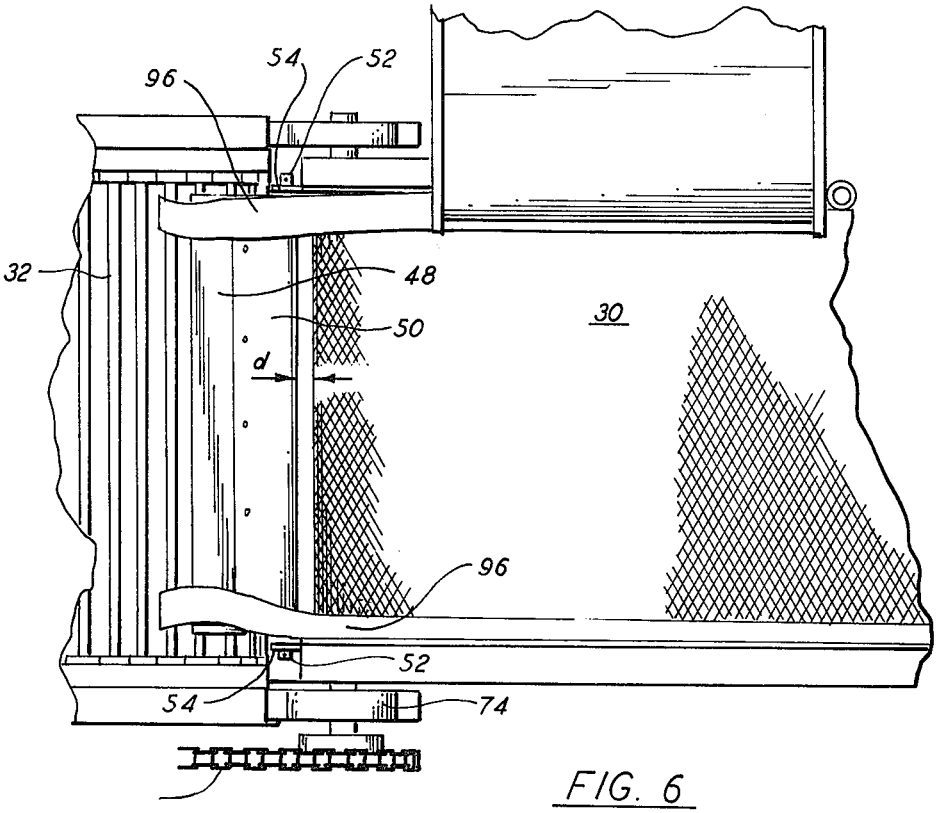
FIG. 6 is a fragmentary plan view of the portion of the harvester where the apparatus of the invention is mounted.
Figure 7:
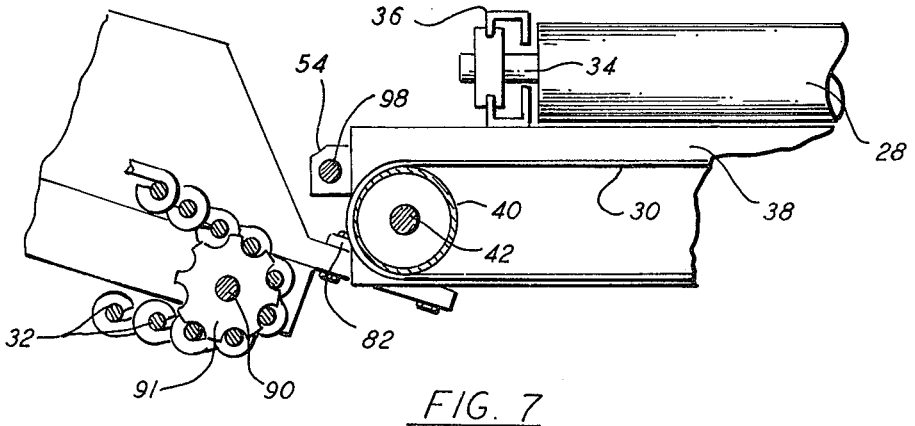
FIGS. 7–11 are a series of views corresponding in all respects to FIGS. 2–6, respectively, showing an alternate construction of a critical element of the apparatus.
Figure 8:
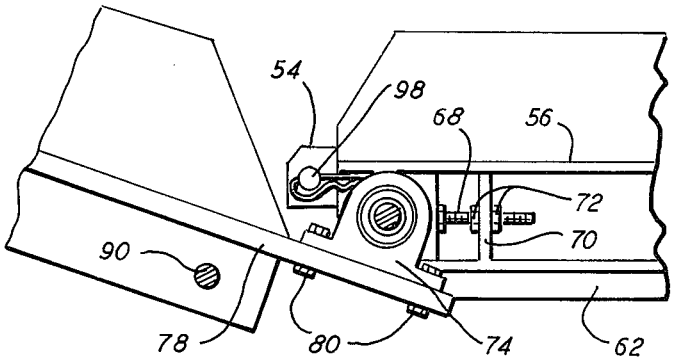
Figure 9:
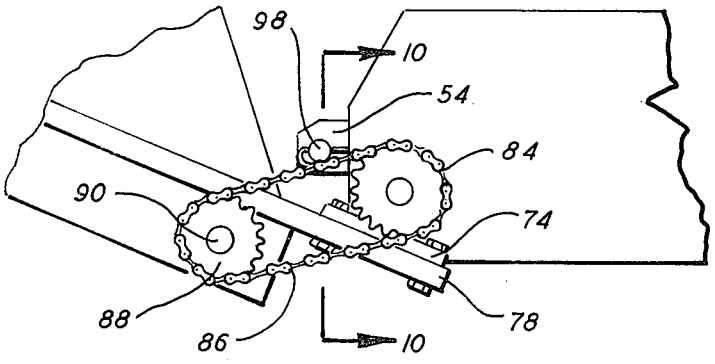
Figure 10:
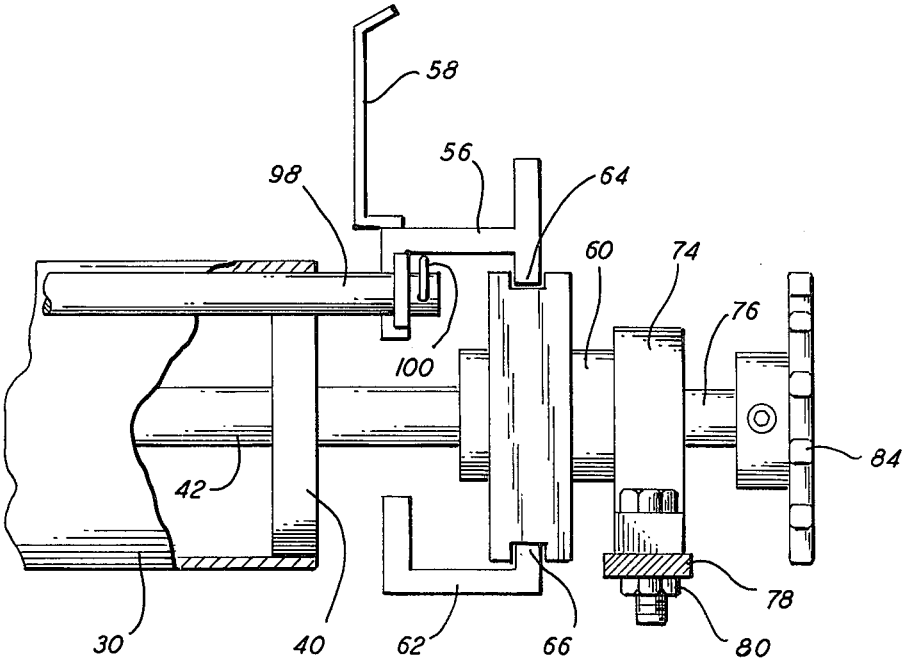
Figure 11:
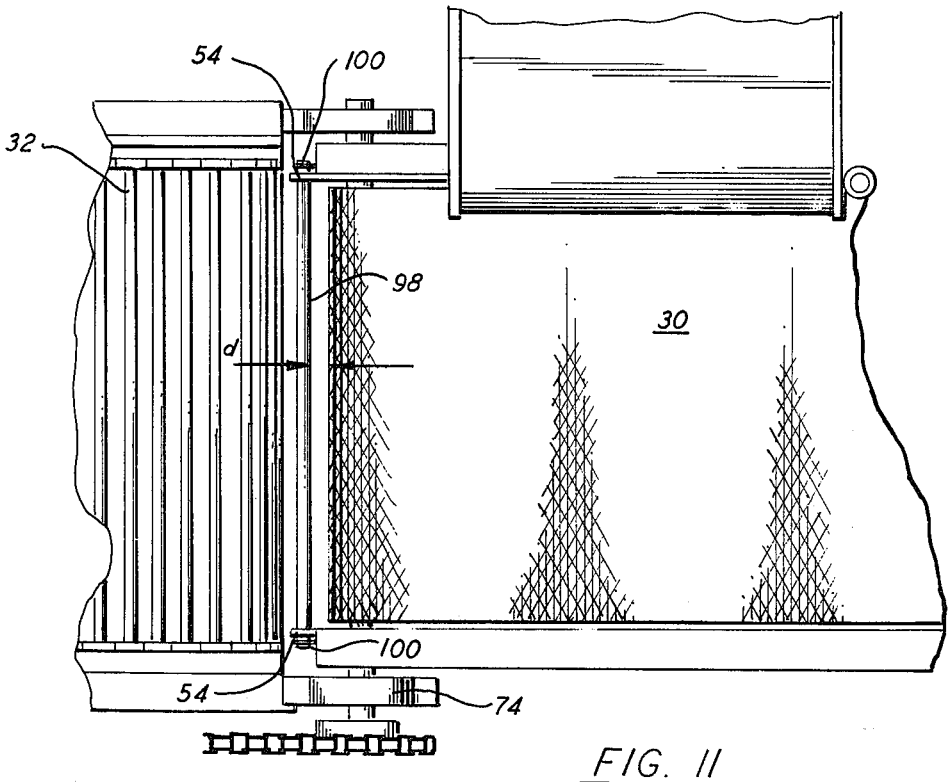

Shaft 42 is mounted at each end upon bearings within housings which are adjustably movable with respect to the stationary frame. The bearing housing and adjustment means are the same at both ends of shaft 42 and the shaft upon which the roller at the opposite end of belt 30 is also mounted at both ends upon the same adjustable bearing housings. Thus, the supports at both ends and both sides of belt 30 are movable to adjust belt tension as necessary. The bearing housing and associated adjustment means at one end of shaft 42 are shown in FIGS. 3–5. Housing 60 is provided with grooves in its upper and lower surfaces into which edges of upper frame portion 56 and lower frame portion 62 extend, forming ways 64 and 66. Bolt 68 extends from one side of housing 60 through a slightly larger opening in plate 70, affixed between frame portions 56 and 62. Nuts 72 are threaded on bolt 68 on opposite sides of plate 70 and may be moved in either direction to adjust the position of housing 60 along ways 64 and 66.

Pillow block 74 is mounted for free rotation upon an extended portion 76 (FIG. 5) of shaft 42. Frame member 78, which carries conveyor chain 32, is attached by bolts 80 to pillow block 74 and to the identical pillow block 82, a small portion of which may be seen in FIG. 2, on the bearing housing at the opposite end of shaft 42. Drive sprocket 84 is affixed to the end of shaft 42 opposite the connection thereof to hydraulic motor 44. Chain 86 encircles drive sprocket 84 and similar sprocket 88 on shaft 90. The shaft also carries suitable sprockets 91 which engage and drive conveyor chain 32. Rod 92 (FIG. 1) extends between fixed hydraulic cylinder 94 and frame member 78 to allow selective raising and lowering of the outer end of the final discharge conveyor. Since frame members 78 are affixed to pillow blocks 74 and 82, pivotal movement is about the same axis as that of drive sprocket 84, whereby the tension of chain 86 is not affected by changing the position of the outer end of the discharge conveyor. It should also be noted that adjusting movement of bearing housing 60 is transmitted through pillow block 74 to frame member 78, thereby moving the lower end of the discharge conveyor together with the bearing housing.

Element 46, being mounted upon brackets 54 extending from stationary frame portions 56, does not move during adjustment of the bearing housings and associated elements. Therefore, the gap between adjacent edges of belt 30 and element 46, identified in FIG. 6 as dimension d, is changed in the course of such adjustment. It will be noted from FIGS. 2–4 that the upper surface of element 46 is substantially coplanar with the upper surface of belt 30. Although the plane of element 46 may change somewhat as conveyor chain 32 and its supporting structure are moved about the axis of shaft 42, the pivoted edge remains in the same plane, i.e., that of the upper surface of belt 30. The non-pivoted edge, i.e., the free edge of strip 48, rides on chain 32 whereby element 46 is continually oscillated for a short distance about its pivotal mounting when chain 32 is running.

As material is discharged from belt 30 to the adjacent edge of element 46, the smaller and more flexible or compressible materials (such as spoiled or crushed fruit) are carried into the gap between belt 30 and element 46, aided by the high traction surface of belt 30. Such materials include plant stems, leaves, sticks, dirt, small stones and small or crushed tomatoes. The desirable portion of the materials, i.e., the larger and undamaged tomatoes, pass over element 46 and onto chain 32 for final discharge into a truck or other receiving structure.

Elongated strips 96 of flexible material such as rubber, plastic or heavy fabric, may be attached to portions of the frame or baffle members along each side of belt 30 and extend to the side edges of the chain. Thus, strips 96 extend across the sides of the gap between belt 30 and chain 32, and also overlap the side edges of element 46 to insure that no tomatoes are lost from the sides of the final discharge section. Thus, the crop discharged from the harvester is virtually free of all unwanted foreign matter, as well as small and damaged fruit, with a minimal loss of desirable fruit.

The embodiment of FIGS. 7–11 has been found to be equally as effective, although simpler in construction than the previously described embodiment. Since many of the elements may be identical to those of the FIGS. 2–6 construction, such elements are shown and numbered identically in FIGS. 7–11 and description of their structure and operation need not be repeated. In this embodiment, element 46 is eliminated, separation of the unwanted materials being effected entirely by the cooperative action of belt 30 and rod 98, supported near its ends for free rotation by brackets 54. Cotter pin 100 extends through a hole in one end of rod 98 for retaining it in the brackets, a similar pin, enlarged head, or other such retaining means being provided at the other end.

The upper surface of rod 98 is approximately in the plane of the upper surface of belt 30, which again is provided with a high traction surface. The necessary gap (again denoted as dimension "d" in FIG. 11) is provided between the discharge end of belt 30 and rod 98, and may be adjusted as desired in the previously described manner.

The construction of FIGS. 7–11 is considered the preferred and best mode of practising the invention. It is again emphasized that the separating action is provided by the high traction surface of solid belt 30 carrying the separable matter (stems, sticks, weeds, dirt, small stones and, particularly, crushed or overly soft tomatoes) downwardly into the gap between the discharge end of the belt and the separator element (rod 98 or element 46) so that it does nor reach the discharge conveyor chain.

What is claimed is:

1. A method of separating soft and crushed fruit and other foreign matter from a supply of machine-harvested tomatoes, comprising:

a. passing a continuous supply of tomatoes and vines through a harvesting machine of the type adapted to remove the fruit from the vines;

b. moving the supply of fruit through the machine to a discharge section including a solid conveyor belt having a high traction surface, and a final discharge conveyor of the open link chain type, the receiving end of said final discharge conveyor being arranged to receive fruit from the discharge end of said belt;

c. positioning a solid rod parallel to and substantially across the entire width of said discharge end of said belt in an adjustably fixed position below and substantially tangent to the plane of the upper surface of said belt, and spaced therefrom by an unobstructed gap sufficient to cause soft and crushed tomatoes to be pulled through said gap by the combined effect of the moving high traction belt surface and fixed rod and firm tomatoes to pass over the rod to the receiving end of said final discharge conveyor.

* * * * *